US010538871B2

(12) United States Patent
Shimada et al.

(10) Patent No.: US 10,538,871 B2
(45) Date of Patent: Jan. 21, 2020

(54) WASHING MACHINE

(71) Applicant: Samsung Electronics Co., Ltd., Gyeonggi-do (KR)

(72) Inventors: Yoshinari Shimada, Yokohama (JP); Takahiro Nakashima, Yokohama (JP); Yuji Aoshima, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/792,600

(22) Filed: Oct. 24, 2017

(65) Prior Publication Data

US 2018/0142398 A1 May 24, 2018

(30) Foreign Application Priority Data

Nov. 24, 2016 (JP) ..... 2016-228377
Mar. 6, 2017 (JP) ..... 2017-042126
Jul. 26, 2017 (KR) ..... 10-2017-0094935

(51) Int. Cl.

*D06F 23/02* (2006.01)
*D06F 37/02* (2006.01)
*D06F 37/26* (2006.01)
*D06F 37/28* (2006.01)

(52) U.S. Cl.

CPC ..... *D06F 37/02* (2013.01); *D06F 23/02* (2013.01); *D06F 37/267* (2013.01); *D06F 37/28* (2013.01); *D06F 2232/08* (2013.01)

(58) Field of Classification Search

CPC ..... D06F 23/02; D06F 37/02; D06F 37/267; D06F 37/28; D06F 2232/08
USPC ..... 34/62; 68/19, 19.2, 20
See application file for complete search history.

(56) References Cited

U.S. PATENT DOCUMENTS 2,957,330 A 10/1960 Cline
6,088,932 A 7/2000 Adamski et al.
2003/0089138 A1* 5/2003 Kawamura ..... D06F 25/00 68/17 R
2005/0016010 A1 1/2005 Pyo et al.
2006/0096334 A1 5/2006 Habu et al.

FOREIGN PATENT DOCUMENTS

CN 202865651 U 4/2013
EP 0795639 A2 9/1997
EP 1314809 A2 5/2003
(Continued)

OTHER PUBLICATIONS

ISA/KR, "International Search Report," International Application No. PCT/KR2017/011887, dated Feb. 7, 2018, 2 pages.
(Continued)

*Primary Examiner* — Levon J Shahinian

(57) ABSTRACT

Disclosed herein is a washing machine capable of suppressing noise during spin-drying caused by a pressure difference in a tub. The washing machine may include a case comprising a laundry loading/unloading opening through which laundry is introduced, a door mounted at the case to open or close the laundry loading/unloading opening, a tub disposed inside the case, a drum rotatably disposed inside the tub, and an air inflow channel configured to guide air to flow toward a central portion of the drum in which a pressure decreases while the drum rotates.

18 Claims, 14 Drawing Sheets

(56) References Cited

FOREIGN PATENT DOCUMENTS

| | | | |
|---|---|---|---|
| EP | 2019163 | A1 | 1/2009 |
| EP | 2393954 | A2 | 12/2011 |
| EP | 2412861 | A1 | 2/2012 |
| EP | 2592182 | A1 | 5/2013 |
| GB | 2044297 | A | 10/1980 |
| JP | 356-1198 | A | 1/1981 |
| JP | 2003-062397 | A | 3/2003 |
| JP | 2007054177 | A | 3/2007 |
| JP | 2007068801 | A | 3/2007 |
| JP | 2012187235 | A | 10/2012 |

OTHER PUBLICATIONS

Supplementary European Search Report dated Aug. 2, 2019 in connection with European Patent Application No. 17 87 3763, 9 pages.

* cited by examiner

WASHING MACHINE

CROSS-REFERENCE TO RELATED APPLICATIONS AND CLAIM OF PRIORITY

This application is related to and claims priority to Japanese Patent Application Nos. 2016-228377 and 2017-042126 respectively filed on Nov. 24, 2016, and Mar. 6, 2017, and Korean Patent Application No. 10-2017-0094935, filed on Jul. 26, 2017, the contents of which are incorporated herein by reference.

TECHNICAL FIELD

Embodiments of the present disclosure relate to a washing machine performing a series of processes of washing, rinsing, and spin-drying by rotating a drum containing clothes with respect to a horizontal axis.

BACKGROUND

In general, as illustrated in FIG. 1, a drum type washing machine is provided with a laundry loading/unloading opening 101 that is closed by a door at the front of an outer case 100 and laundry such as clothes is introduced there into through the laundry loading/unloading opening 101. A cylindrical tub 102 with a bottom is placed horizontally in the outer case 100. A cylindrical drum 103 having a bottom and a circumferential wall provided with a plurality of through-holes is rotatably disposed in the tub 102. A series of processes of washing, rinsing, and spin-drying are automatically performed in a state where clothes are contained in the drum 103.

The tub 102 may be disposed such that an opening is positioned adjacent to the laundry loading/unloading opening 101 to face the laundry loading/unloading opening 101. The tub 102 may be elastically supported by the outer case 100 by using a suspension or the like. A gap between the opening of the tub 102 and the laundry loading/unloading opening 101 may be sealed by an elastic packing material or the like to prevent water leakage.

The tub 102 becomes in an approximately sealed state by closing the door of the laundry loading/unloading opening 101 when it is in use. However, it is not an airtight state but a so-called watertight state. That is, even in washing, rinsing, and spin-drying cycles, the inside of the tub 102 generally communicates with the outside via a water supply path or a drain path disposed at radially outward portions of the tub 102. Thus, air may flow out of the tub 102.

SUMMARY

The drum 103 rotates about a rotational axis J at a high speed to remove moisture from laundry during spin-drying. In this case, air contained in the drum 103 is also forced to flow in a radially outward direction as indicated by arrows A of FIG. 1. In this case, air flowing out of the drum is returned into the drum 103 from areas surroundings of an opening of the drum 103 as indicated by arrows B if there is a sufficient gap between an outer circumferential surface of the drum 103 and an inner circumferential surface of the tub 102. Also, since a bottom surface of the drum 103 has holes, air, even in a small amount, may be returned into the drum 103 through the holes of the bottom surface of the drum 103 as indicated by an arrow B' of FIG. 1.

However, an airflow is formed in a radially outward direction in the drum 103. Thus, the returned air is immediately drawn into the airflow when it enters the drum 103. As a result, it is difficult for the air to reach a central portion of the drum 103.

In addition, a part of air forced to flow out of the drum 103 flows out of the tub 102 through a water supply path or a drain path so that an amount of air contained in the tub 102 decreases.

Particularly in recent years, the capacity of the drum 103 has increased and thus a gap between the outer circumferential surface of the drum 103 and the inner circumferential surface of the tub 102 has narrowed. Thus, reflux of air into the drum 103 is inhibited and air easily flows out of the tub 102 through the water supply path or drain path.

As a result, a pressure at the central portion of the tub 102 becomes lower than that of outer peripheral portions. Due to the pressure difference, the tub 102 elastically supported in the case 100 is pulled forward as indicated by an arrow C of FIG. 1.

As a result, the tub 102 moves forward and brought into contact with surrounding members making noise and causing discomfort to a user.

To address the above-discussed deficiencies, it is a primary object to provide a washing machine capable of suppressing noise during spin-drying caused by a pressure difference in a tub.

Additional aspects of the disclosure will be set forth in part in the description which follows and, in part, will be obvious from the description, or may be learned by practice of the disclosure.

In accordance with one aspect of the present disclosure, a washing machine includes a case comprising a laundry loading/unloading opening through which laundry is introduced, a door mounted at the case to open or close the laundry loading/unloading opening, a tub disposed inside the case, a drum rotatably disposed inside the tub, and an air inflow channel configured to guide air to flow toward a central portion of the drum in which a pressure decreases while the drum rotates.

The air inflow channel may be provided between a front end portion of the drum and the door or between a rear end portion of the drum and the tub.

The tub may include an opening connected to the laundry loading/unloading opening and an end wall facing the opening, and the air inflow channel may include an air inlet formed at a rear surface of the door or at the end wall.

The air inlet may be formed at an upper portion than a rotational axis of the drum.

The washing machine may further include a cover member mounted on an outer surface of the end wall to constitute the air inflow channel and comprising an external air inlet through which air is introduced, wherein the external air inlet is disposed at an upper portion of the tub.

A rib radially extending from the center of the end wall may be provided on the outer surface of the end wall, and the rib may constitute one surface of the air inflow channel.

The cover member may further include a rib fitting part fitted to the rib.

The tub may further include a cylindrical main body wall, an air outlet to discharge air is formed at one portion of the main body wall, and the air inflow channel may connect the air outlet with the air inlet.

The washing machine may further include a cover member mounted on the outer surface of the end wall and configured to guide air into the air inlet and an auxiliary cover member mounted on an outer surface of the main body wall and configured to guide air from the air outlet to an upper portion of the cover member.

The tub may include a cylindrical main body wall facing a circumferential wall of the drum with a gap therebetween, and the air inflow channel may be formed by designing a gap between at least one of a front end portion and a rear end portion of the circumferential wall and the main body wall to be greater than a gap between a middle portion of the circumferential wall and the main body wall.

The air inflow channel may be formed by disposing a baffle plate extending between a rear end portion of the drum and the tub to face an inner surface of the tub with a gap therebetween.

In accordance with another aspect of the present disclosure, a washing machine include a case comprising a laundry loading/unloading opening through which laundry is introduced, a door mounted at the case to open or close the laundry loading/unloading opening, a tub disposed inside the case and having an opening connected to the laundry loading/unloading opening, a drum rotatably disposed inside the tub, and an air inlet disposed at one surface of the tub or one surface of the door to allow air to flow to a central portion of the drum while the drum rotates.

The tub may include an end wall facing the opening, and the air inlet may be formed at one portion of the end wall.

The washing machine may further include a cover member mounted on one surface of the end wall and connected to the air inlet to constitute an air inflow channel configured to guide air.

The air inflow channel may include an inlet through which air is introduced and an outlet through which air is discharged, and the inlet may be disposed at an upper portion than the outlet to prevent water contained in the tub from flowing out of the tub through the air inflow channel.

The tub may include a cylindrical main body wall, and an air outlet formed at one portion of the main body wall to discharge air contained in the drum while the drum rotates.

The washing machine may further include a cover member mounted on the outer surface of the end wall and configured to guide air into the air inlet, and an auxiliary cover member mounted on an outer surface of the main body wall and configured to guide air from the air outlet to an upper portion of the cover member.

In accordance with another aspect of the present disclosure, a washing machine includes a case comprising a laundry loading/unloading opening through which laundry is introduced, a tub disposed inside the case and comprising an end wall facing the laundry loading/unloading opening and a cylindrical main body wall, a drum rotatably disposed inside the tub, and an air inflow channel configured to guide air toward a central portion of the drum while the drum rotates.

The air inflow channel may be formed by designing a gap between at least one of a front end portion and a rear end portion of the circumferential wall and the main body wall to be greater than a gap between a middle portion of the circumferential wall and the main body wall.

The air inflow channel may be formed by disposing a baffle plate extending between a rear end portion of the drum and the tub to face an inner surface of the tub with a gap therebetween.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 13, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Figure 1:
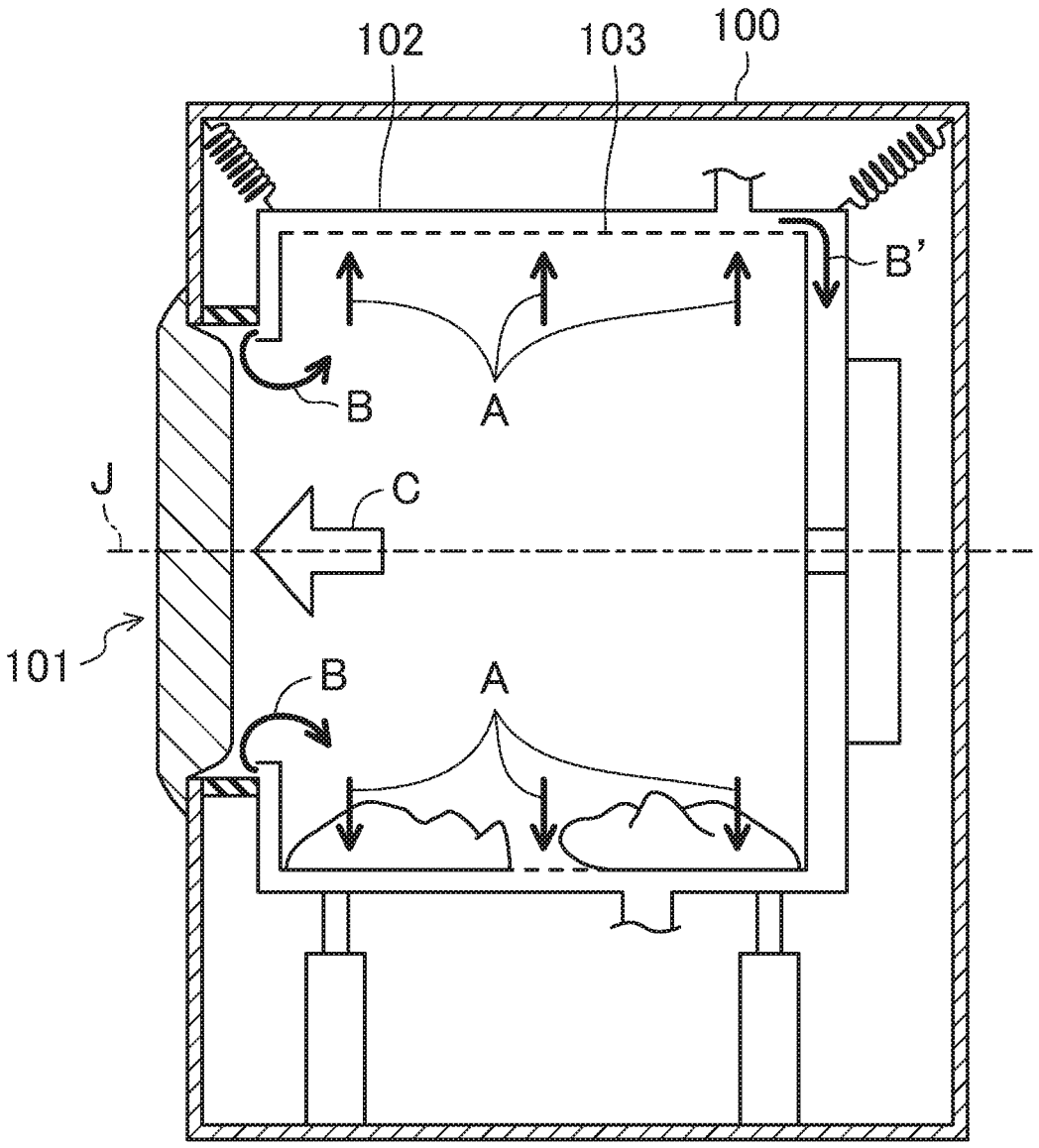
FIG. 1 is a schematic view illustrating a structure of a conventional drum type washing machine.
Figure 2:
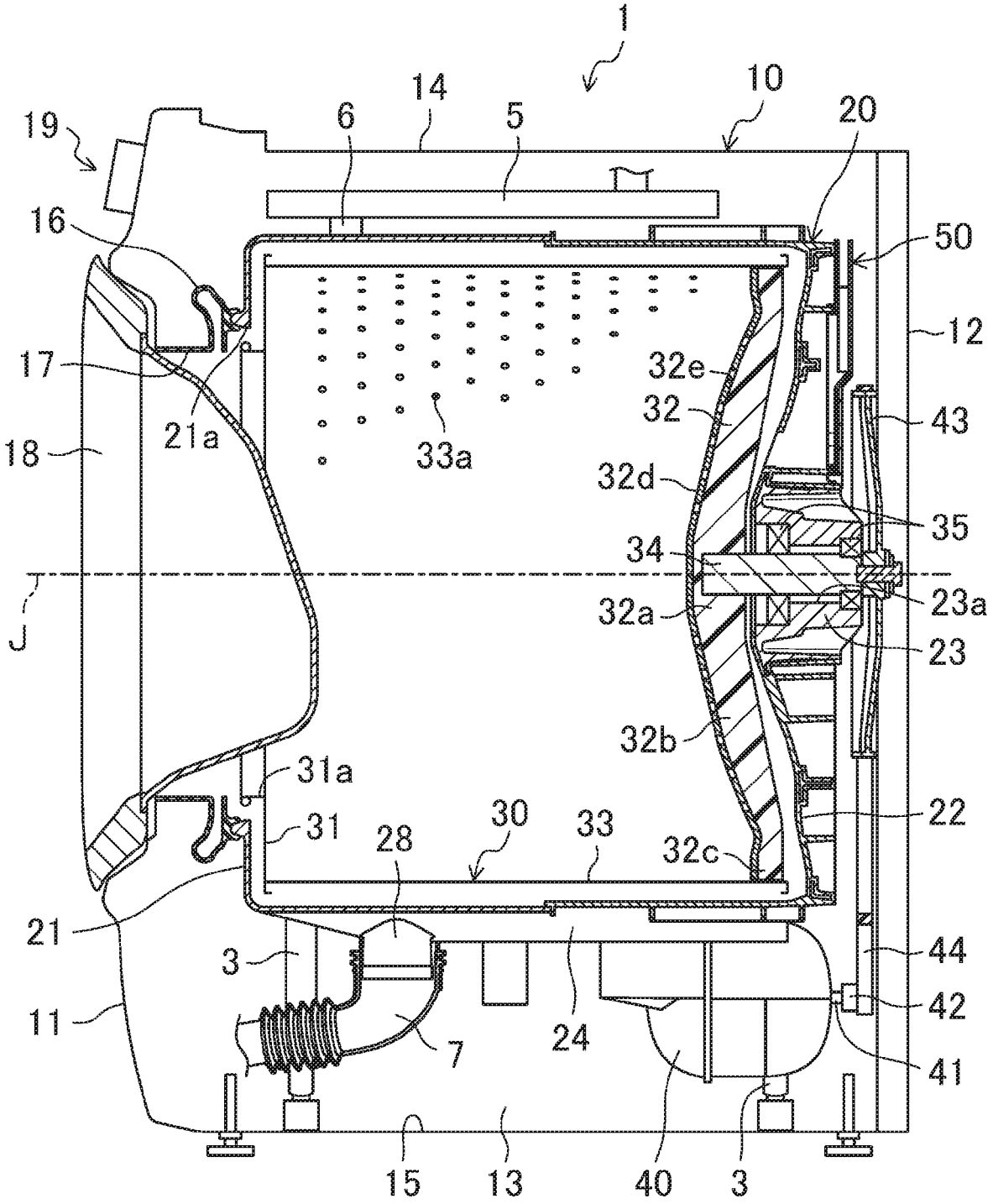
FIG. 2 is a side sectional view illustrating an internal structure of a washing machine according to an embodiment of the present disclosure.
Figure 3:
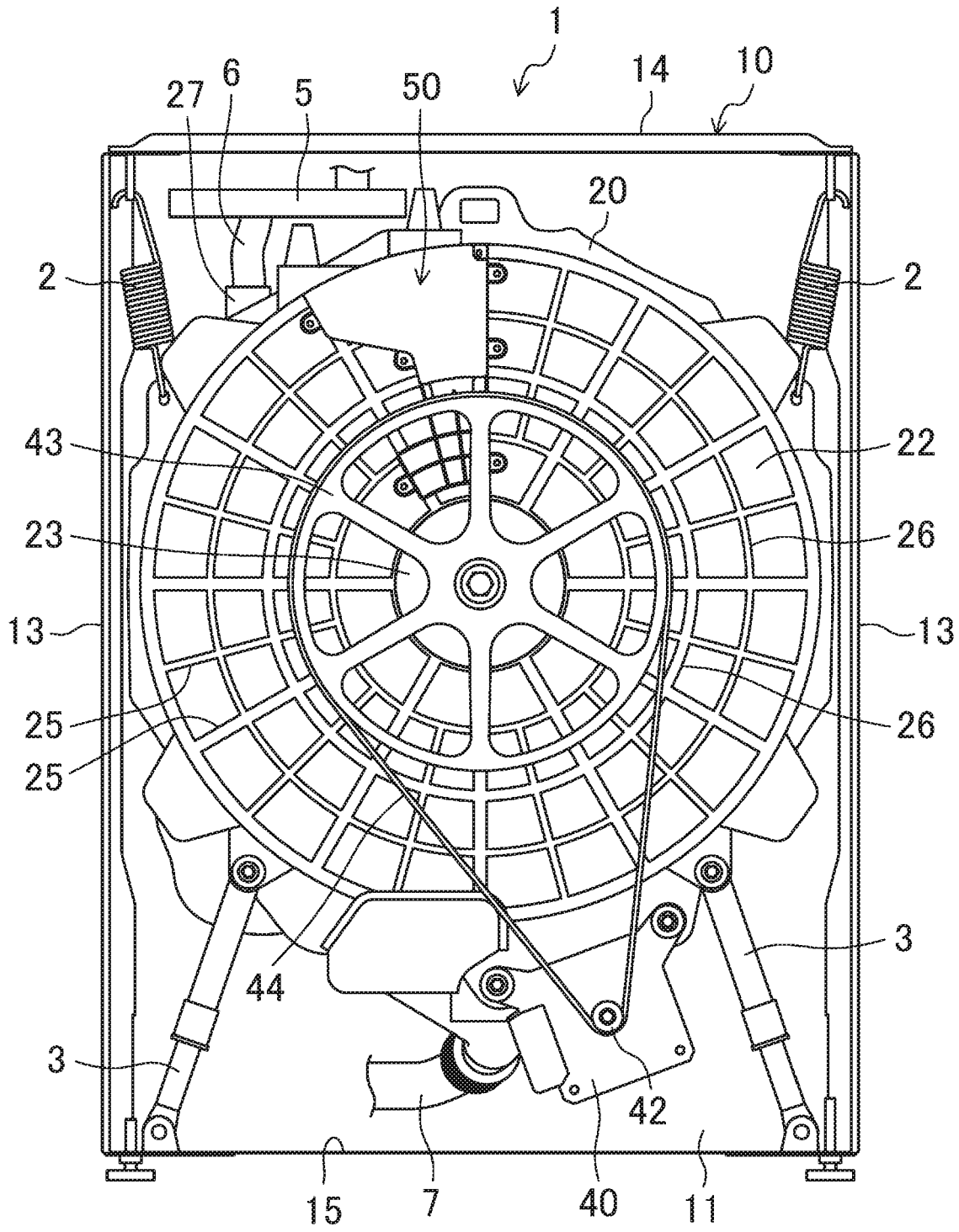
FIG. 3 is a rear view illustrating an internal structure of a washing machine according to an embodiment of the present disclosure.

FIGS. 2 and 3 illustrate a washing machine 1 according to an embodiment of the present disclosure. The washing machine 1 may be a fully automatic washing machine that automatically performs a series of processes of washing, rinsing, and spin-drying. In addition, although the washing machine 1 is not provided with a function of a dryer, the present disclosure may also be applied to a combo washer dryer in which washing machine and clothes dryer are merged into a single device.

The washing machine 1 may include an outer case 10, a tub 20, a drum 30, and a motor 40. The outer case 10 may be provided in a rectangular parallelepiped shape formed by assembling a front panel 11, a rear panel 12, a pair of side panels 13, a top panel 14, and a bottom panel 15. The front panel 11 is provided with a circular laundry loading/unloading opening 17 that is opened or closed by a door 18 mounted with an annular diaphragm 16. A control unit 19 such as a switch or a monitor allowing a user to drive the washing machine 1 may be disposed at an upper portion than the laundry loading/unloading opening 17.

The tub 20 is formed of a cylindrical container with a bottom made of an injection molded member of a resin and includes a circular opening portion 21 having an opening 21*a* with the substantially same diameter as the laundry loading/unloading opening 17, a disk-shaped end wall 22 facing the opening portion 21, and a cylindrical main body wall 23 interposed therebetween. A bearing housing 23 having a shaft hole 23*a* and formed of an alloy of aluminum or the like is integrated with a resin at the central region of the end wall 22.

The outer surface of the end wall 22 is provided with a plurality of diametric ribs 25 that radially extends from the central region and a plurality of circumferential ribs 26 that are arranged to as concentric circles around the central region to reduce weight of the tub 20 and increase rigidity thereof. The outer surface of the end wall 22 is also provided with a cover member 50 which will be described later.

The tub 20 is horizontally located in the outer case 10 such that the opening portion 21 faces forward and the opening 21*a* and the laundry loading/unloading opening 17 are located to horizontally overlap each other. A pair of springs 2 is installed at front and rear upper portions inside the outer case 10 to be spaced apart from each other in the horizontal direction and a pair of dampers 3 is installed at left and right lower portions inside the outer case 10 to be spaced apart from each other in the horizontal direction. The tub 20 is elastically supported by the outer case 10 via the springs 2 and dampers 3.

The opening portion 21 is connected to the diaphragm 16 and a gap between the laundry loading/unloading opening 17 and the opening 21*a* is sealed by the diaphragm 16. Thus, the opening 21*a* is sealed by closing the door 18.

A water receiving container 5 that receives water supplied from the outside around an upper part of the tub 20. The water receiving container 5 is connected to a water supply port 27 installed at an upper portion of the tub 20 through a water supply hose 6 and a predetermined amount of water is supplied into the tub 20 via the water receiving container 5 and the water supply port 27 during the washing or rinsing cycle. Air contained in the tub 20 may be discharged out of the tub 20 via the water supply hose 6 and the water receiving container 5.

A drain port 28 is installed at a lower portion of the tub 20. A drain hose 7 is connected to the drain port 28. One end portion of the drain hose 7 is exposed to the outside of the outer case 10. A circulation pump may be provided at an upstream side of the drain hose 7 to circulate water stored in the tub 20 during the washing or rinsing cycle. During draining or spin-drying or when not in use, the inside of the tub 20 communicates with the outside of the tub 20 through the drain hose 7 so that air inside the tub 20 may flow out.

The drum 30 is a cylindrical container slightly smaller than the tub 20 and includes a circular front portion 31 having a drum opening 31*a* with a slightly smaller diameter than the opening 21*a*, a flange shaft 32 facing the front portion 31, and a cylindrical circumferential wall 33 connecting the front portion 31 with the flange shaft 32. An outer circumferential surface of the circumferential wall 33 faces an inner circumferential surface of the main body wall 24 with a slight gap (micro-gap) therebetween. The circumferential wall 33 has a plurality of through-holes 33*a* (a group of pores) penetrating the circumferential wall 33 (FIG. 2 illustrates a part thereof) and formed over the entire surface thereof.

The flange shaft 32 includes a boss portion 32*a* to which one end of the shaft 34 is fixed, an arm portion 32*b* radially extending from the boss portion 32*a*, and a circular flange portion 32*c* leading to a tip end of each arm portion 32*b* and fixed to the circumferential wall 33.

The front surface of the flange shaft 32 is covered with a disk-shaped cover 32*d* having a plurality of holes 32*e*. The cover 32*d* constitutes the bottom surface of the drum 30. The shaft 34 is supported in the shaft hole 23*a* of the bearing housing 23 by the bearing 35 and the drum 30 rotates about a substantially horizontal rotational axis J in the tub 20.

The motor 40 is mounted under the tub 20 such that a drive shaft 41 thereof protrudes backward parallel to the rotational axis J. A sub pulley 42 having a smaller diameter is fixed to a tip end of the drive shaft 41. Meanwhile, a main pulley 43 having a larger diameter is fixed to one end of the shaft 34 protruding out from the tub 20 through the shaft hole 23*a*. An endless belt 44 is installed at the sub pulley 42 and the main pulley 43.

Driving of the motor 40 is controlled by a control device (not shown) that controls the overall operation of the washing machine 1. In accordance with programs stored in the control device, rotational direction or rotational speed of the driver shaft 41 vary at a predetermined timing. Thus, during the washing cycle or rinsing cycle, the drum 30 rotates at a low speed, e.g., 30 rpm, at which clothes are not in contact with the circumferential wall 33 in a state where wash water or rinse water is retained in the tub 20, and clothes are agitated with wash water.

In the spin-drying cycle during which water drains from the tub 20, the drum 30 rotates at a speed at which clothes are forced to be in contact with the circumferential wall 33 to perform a spin-drying process. That is, the inside of the tub 20 communicates the outside thereof through the water supply hose 6 or the drain hose 7 and the drum 30 rotates at a high speed of 1000 rpm or higher for a predetermined time period in a state where air passes therethrough. Thus, water contained in the clothes flows out of the drum 30 through the through-holes 33*a*, contained in the tub 20, and drains via the drain hose 7.

In this case, since air also flows out of the drum 30 as described above, a pressure of the central portion of the tub 20 decreases so that the tub 20 is pulled and moved forward. Thus, the tub 20 may generate noise due to friction with members around the tub 20 causing discomfort to the user. Thus, an air inflow structure that supplies air into the central portion of the drum 30 may be disposed between the drum 30 and the tub 20 in the washing machine 1 such that a pressure difference is not caused in the tub 20.

That is, since the pressure of the central portion of the tub 20 is relatively low, an air inlet communicating with the outside of the tub 20 is formed at the central region of the end wall 22 facing the inside of the tub 20. The air inlet is located at the central portion of the tub 20, and thus air may flow into the central portion of the tub 20 without being disturbed by an airflow formed inside the drum 30 in a radially outward direction. Therefore, a pressure difference is not caused in the tub 20.

Figure 4:
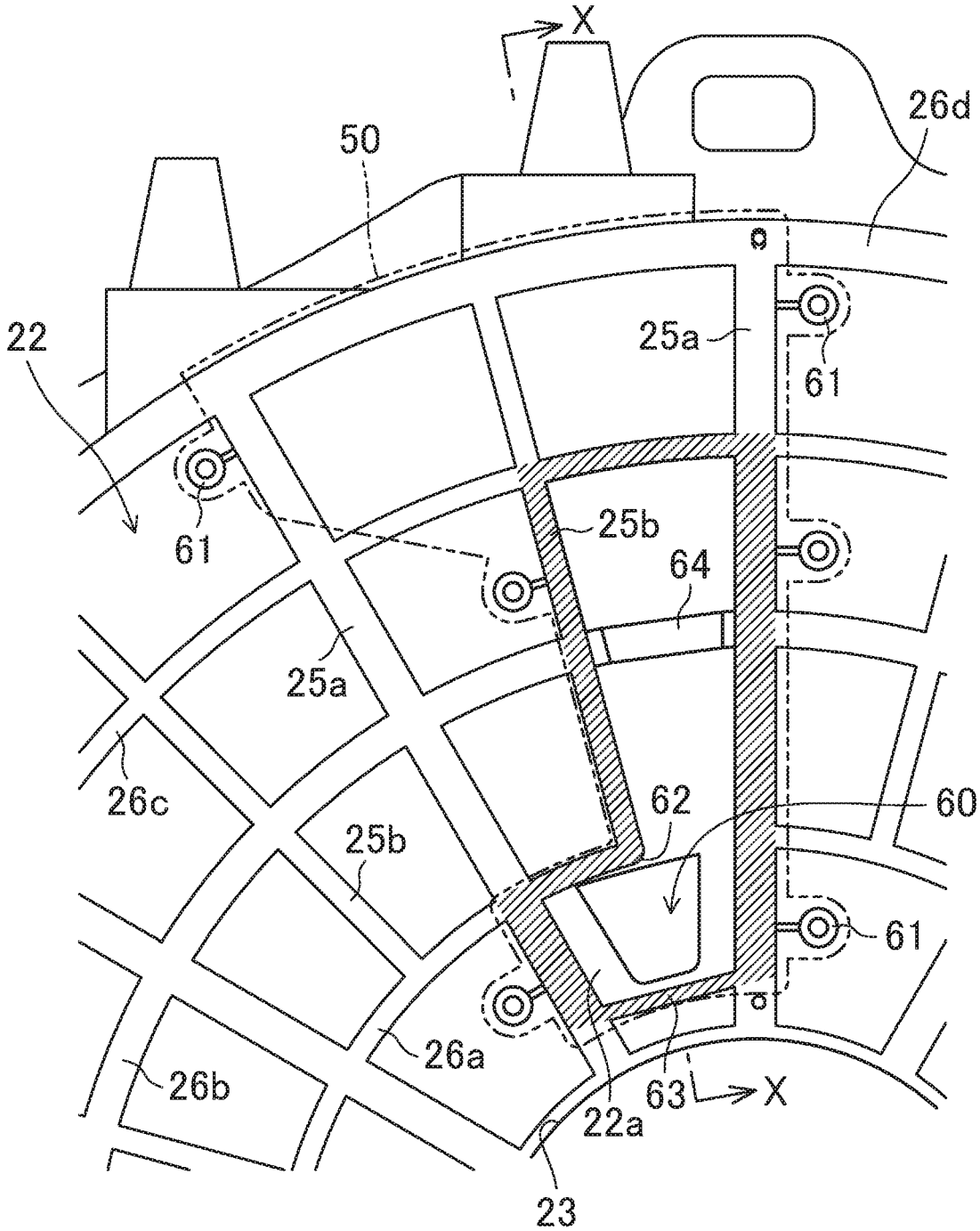
FIG. 4 is a schematic view illustrating a main part of an outer surface of an end wall portion.
Figure 5:
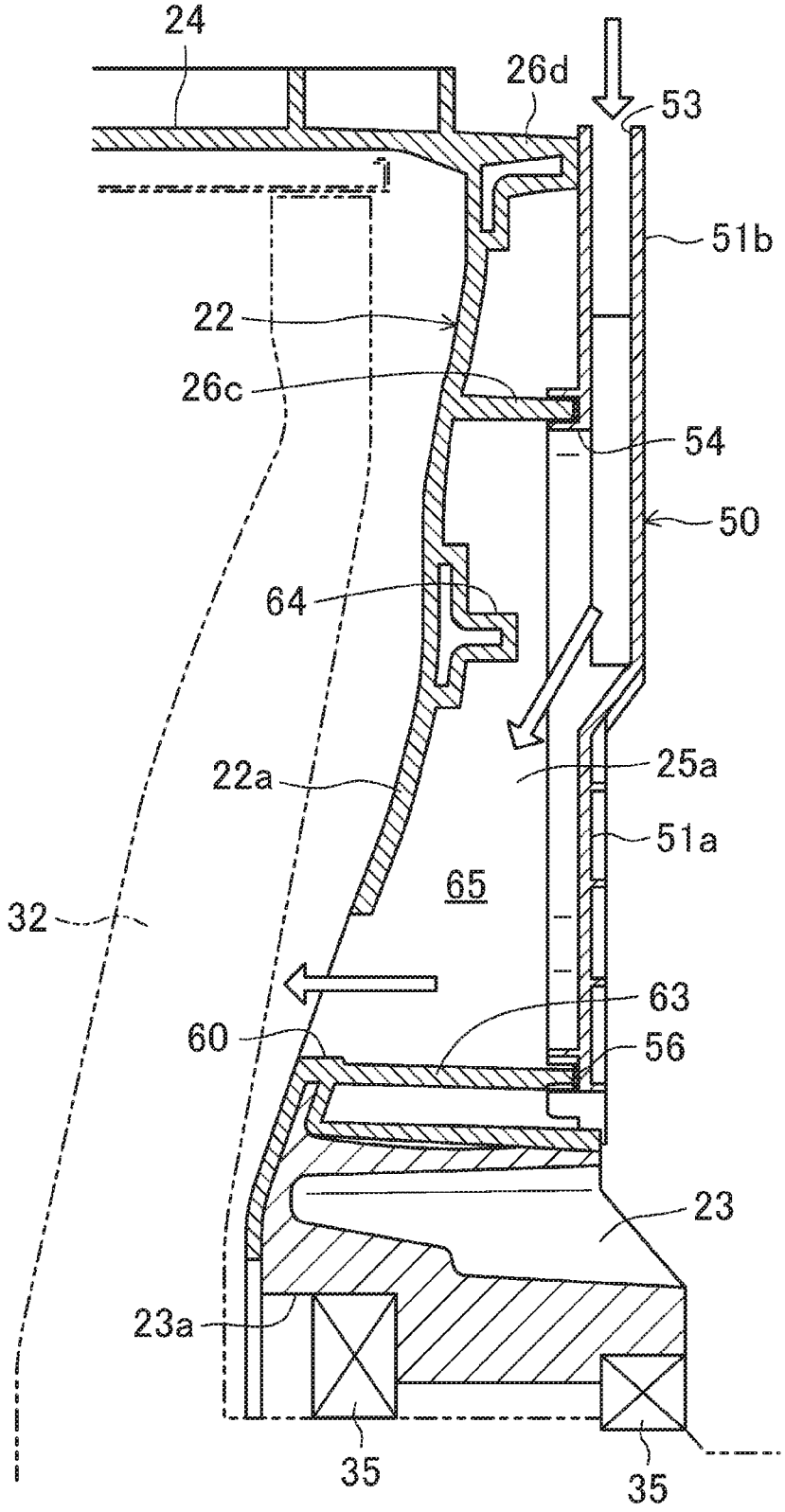
FIG. 5 is a cross-sectional view taken along the line X-X in FIG. 4.

More particularly, as illustrated in FIGS. 4 and 5, an air inlet 60 penetrating the wall is formed at a central region of the end wall 22, particularly, around an upper portion of the bearing housing 23. The air inlet 60 is disposed in the vicinity of the upper portion of the bearing housing 23 since a resin is easily molded and it is difficult for water or bubbles to flow out of the tub 20 through the air inlet 60 during the washing or rinsing cycle among central regions.

In addition, an air inflow path is formed in the washing machine 1 by mounting a cover member 50 on the outer surface of the end wall 22 to prevent water or bubbles from flowing into the outer case 10 even after water or bubbles flow out of the air inlet 60.

Figure 6:
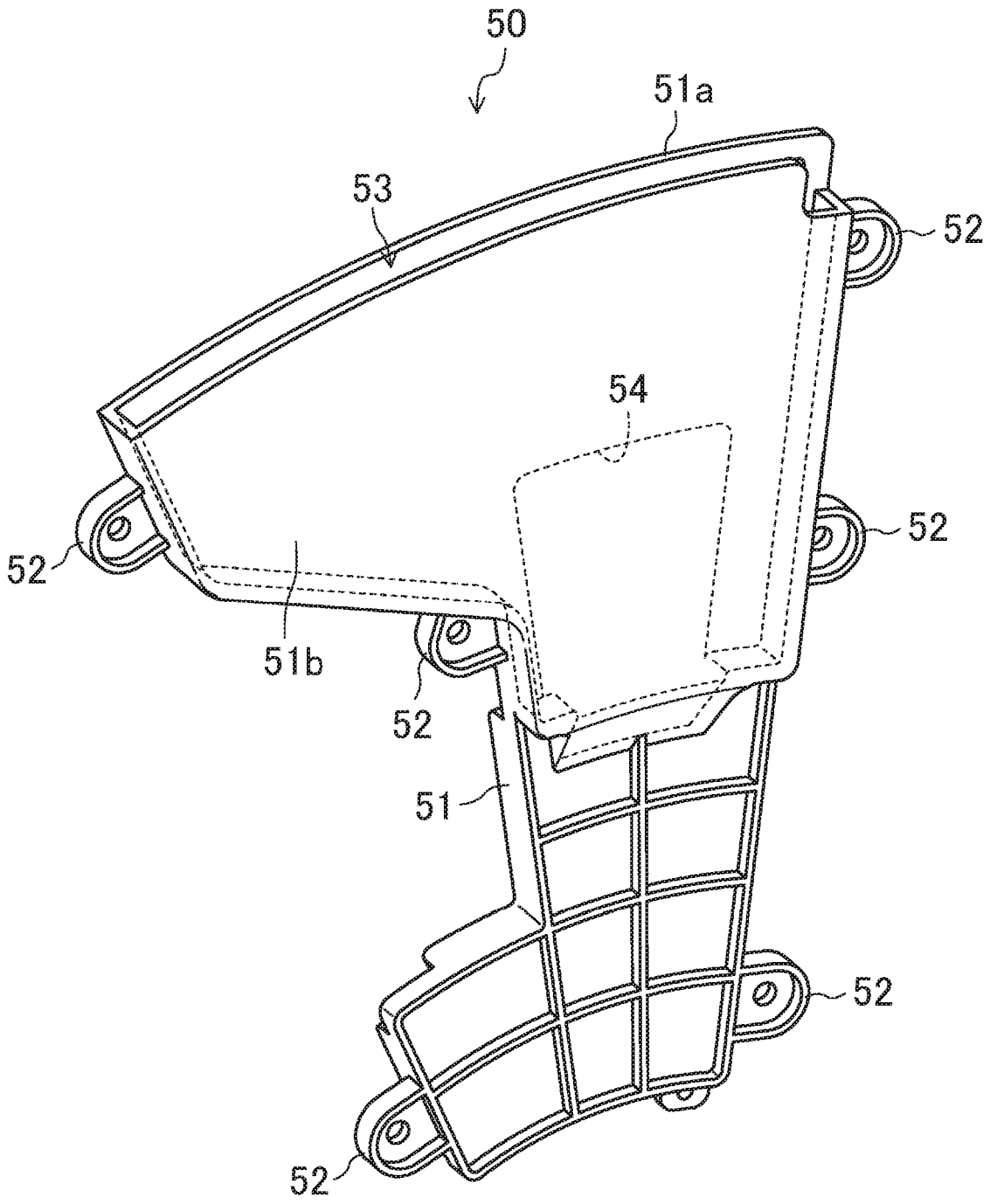
FIG. 6 is a perspective view illustrating an outer side of a cover member.
Figure 7:
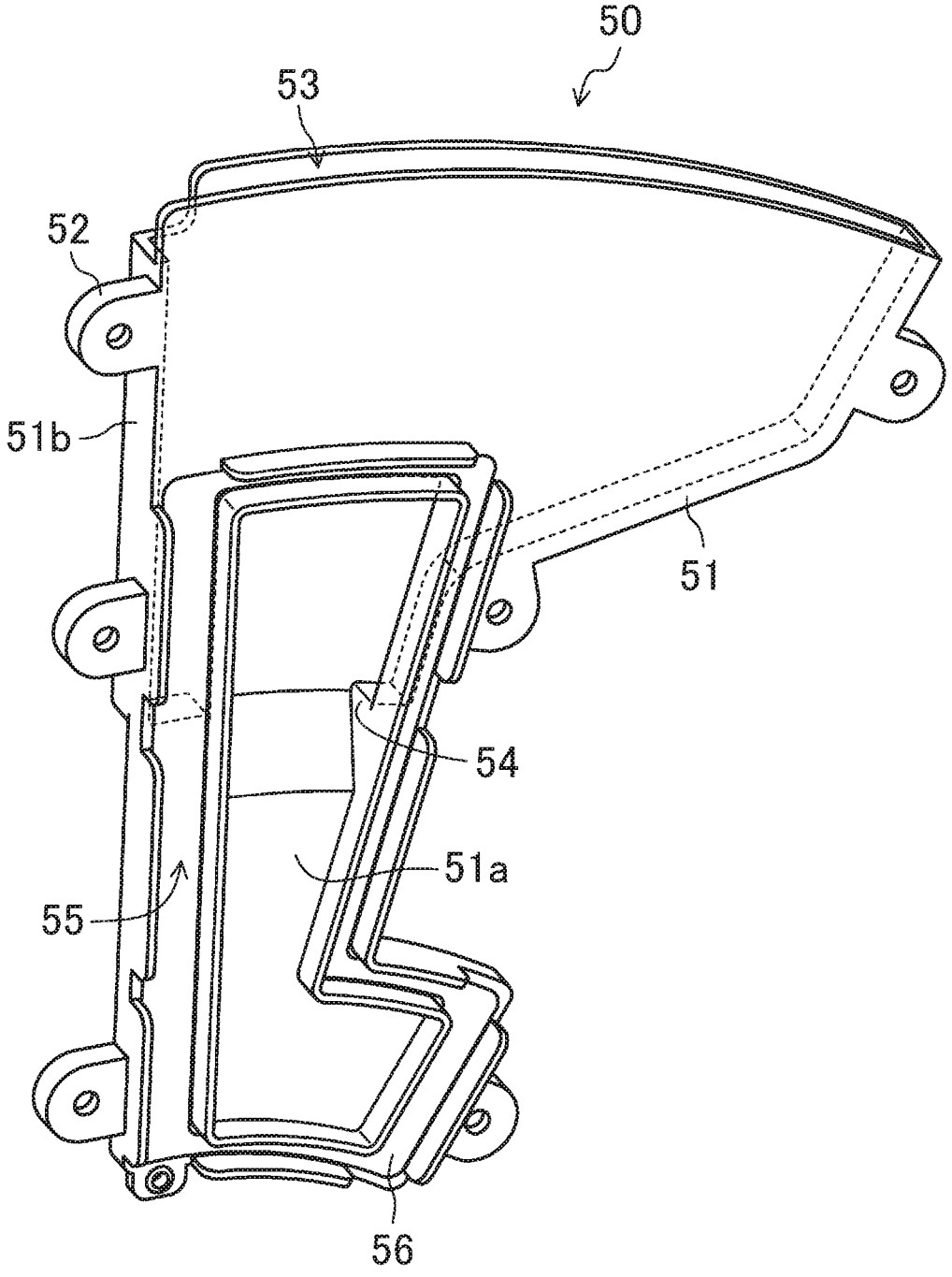
FIG. 7 is a perspective view illustrating an inside of a cover member.

The cover member 50 is illustrated in FIGS. 6 and 7. The cover member 50 may be formed of an injection molded product of a plate type resin and may include a cover body 51 having a shape corresponding to a structure of the outer surface of the end wall 22 and fastening flanges 52 protruding from a plurality of portions of an outer circumference of the cover body 51.

The cover body 51 has a plate-shaped first plate part 51*a* and a second plate part 51*b* that forms a channel having a small thickness at a portion of the first plate part 51*a*. The second plate part 51*b* has an external air inlet 53 having a large width at one end thereof and communicates a middle opening 54 formed at the center of the first plate part 51*a* with an external air input 53.

The first plate part 51*a* has a rib fitting part 55 to engage the diametric rib 25 with the circumferential rib 26. The rib fitting part 55 is formed in a rim shape along the outer periphery of a predetermined region of the first plate part 51*a* including the middle opening 54. The rib fitting part 55 may be provided with an elastic packing 56.

Meanwhile, a path forming structure constituting an air inflow path may be formed using the diametric rib 25 and the circumferential rib 26 at a portion of the end wall 22 mounted with the cover body 51.

Specifically, as illustrated in FIG. 4, fastening bosses 61 are provided at a plurality of locations of the outer surface of the end wall 22 to correspond to the arrangement of the fastening flanges 52. As the circumferential ribs 26, a first circumferential rib 26*a*, a second circumferential rib 26*b*, a third circumferential rib 26*c*, and a fourth circumferential rib 26*d* are sequentially disposed on the outer surface of the end wall 22 from the center thereof at predetermined intervals. The first circumferential rib 26*a* and the third circumferential rib 26*c* are sub ribs which are thinner than the second circumferential rib 26*b* and the fourth circumferential rib 26*d* which are main ribs. The main ribs and the sub ribs are alternately arranged in the radial direction.

Also, the diametric ribs 25 include thicker main ribs and thinner sub ribs which are alternately arranged in the circumferential direction. While main diametric ribs 25*a* of the diametric ribs 25 extend from the central portion to the outer circumferential side, sub diametric ribs 25*b* of the diametric ribs 25 extend from the outer circumference of the first circumferential rib 26*a*. Protruding ends of the diametric ribs 25 and protruding ends of the circumferential ribs 26 are connected with each other and located at the substantially same height.

The air inlet 60 is formed to have a large area using a relatively large space between two adjacent main diametric ribs 25*a* which are disposed closer to the center than the first circumferential rib 26*a*. A communication path 62 is formed in the radial direction by removing a half of one portion of the first circumferential rib 26*a* defined by adjacent sub diametric ribs 25*b*.

A reinforcing rib 63 is installed between adjacent main diametric ribs 25*a* disposed at both sides of the air inlet 60 at the center of the air inlet 60 in order to prevent a decrease in rigidity of the end wall 22 caused by formation of the communication path 62 and the air inlet 60. A portion of the second circumferential rib 26*b* (main rib) between the main diametric rib 25*a* and the sub diametric rib 25*b* adjacent to the communication path 62 may be formed to have a relatively low height, e.g., about half as high as the other portions (lower rib 64).

As illustrated in FIGS. 3, 4, and 5, the cover member 50 is mounted on the end wall 22 to cover a predetermined portion of the outer surface of the end wall 22 in a state where the external air inlet 53 faces upward by screw fixing each of the fastening flanges 52 overlapping each of the fastening bosses 61. Thus, the rib fitting part 55 is brought into close contact with a predetermined region (marked as oblique lines in FIG. 4) of the protruding ends of the diametric rib 25 and the circumferential rib 26 via a packing 56, so that a closed space defined by the diametric rib 25 and the circumferential rib 26 constituting the predetermined region, the wall surface 22*a* of the end wall 22 having the air inlet 60, and the first plate part 51*a* is formed on the outer surface of the end wall 22.

As illustrated in FIG. 5, the closed space 65 communicates with the second plate part 51*b* via the middle opening 54 by disposing the lower rib 64 below the middle opening 54. Thus, the air inflow path is formed upward from the central region of the outer surface of the end wall 22, and the air inlet 60 communicates with the outside of the tub 20 through the external air inlet 53 located at an upper portion of the tub 20.

Since side walls of the air inflow path are defined by the diametric rib 25 and the circumferential rib 26 installed at the outer surface of the end wall 22, the cover member 50 has a simple structure. In addition, since the side walls are coupled with the thin second plate part 51*b*, the air inflow path may have a large volume without protruding from the end wall 22. As indicated by arrows of FIG. 5, air may be efficiently introduced into the center inside the tub 20. As the air inflow path protrudes farther from the end wall 22, the volume of the tub 20 should be reduced with respect to the outer case 10. However, there is no need to reduce the volume of the tub 20 in the washing machine 1, thereby increasing the volume of the tub 20.

Even when water or bubbles flow out of the tub 20 through the air inlet 60, the water or bubbles cannot flow out of the external air inlet 53 located at an upper portion of the tub 20 since the air inflow path is formed outside the air inlet 60. Thus, it is possible to prevent water or bubbles from flowing into the outer case 10.

Since the lower rib 64 to prevent water or bubbles from flowing out is disposed in the middle of the air inflow path, water or bubbles may not flow into the outer case 10.

Embodiment

Figure 8A:
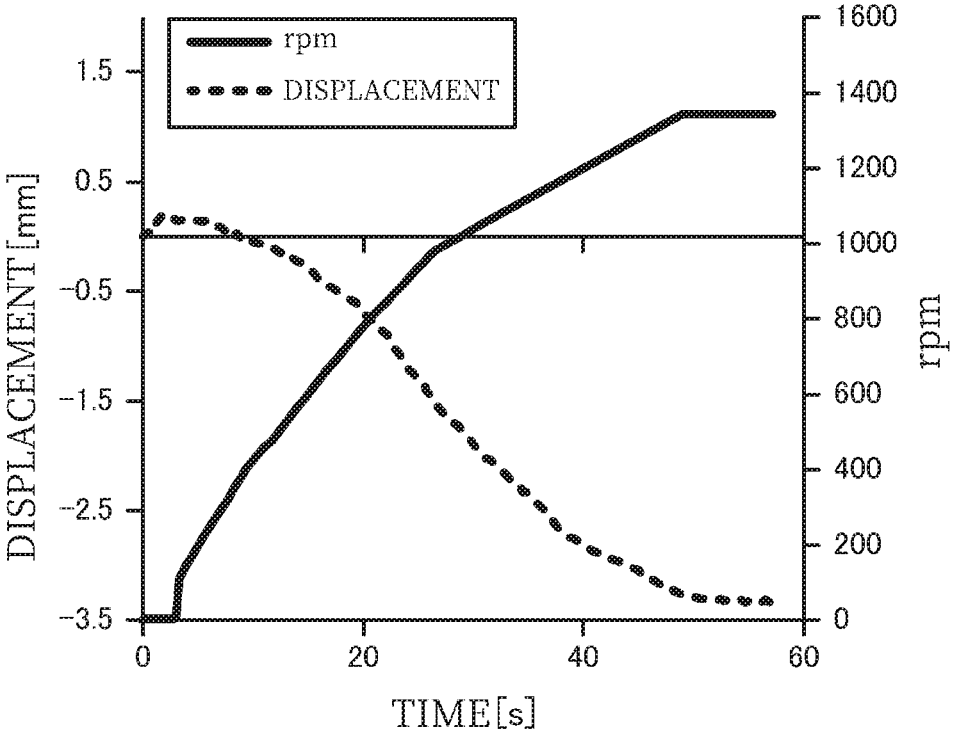
FIG. 8A is a graph illustrating the relationship between change in revolution per minute (rpm) of a drum and the degree of displacement (mm) of a tub forward during spin-drying of a washing machine (Comparative Embodiment).
Figure 8B:
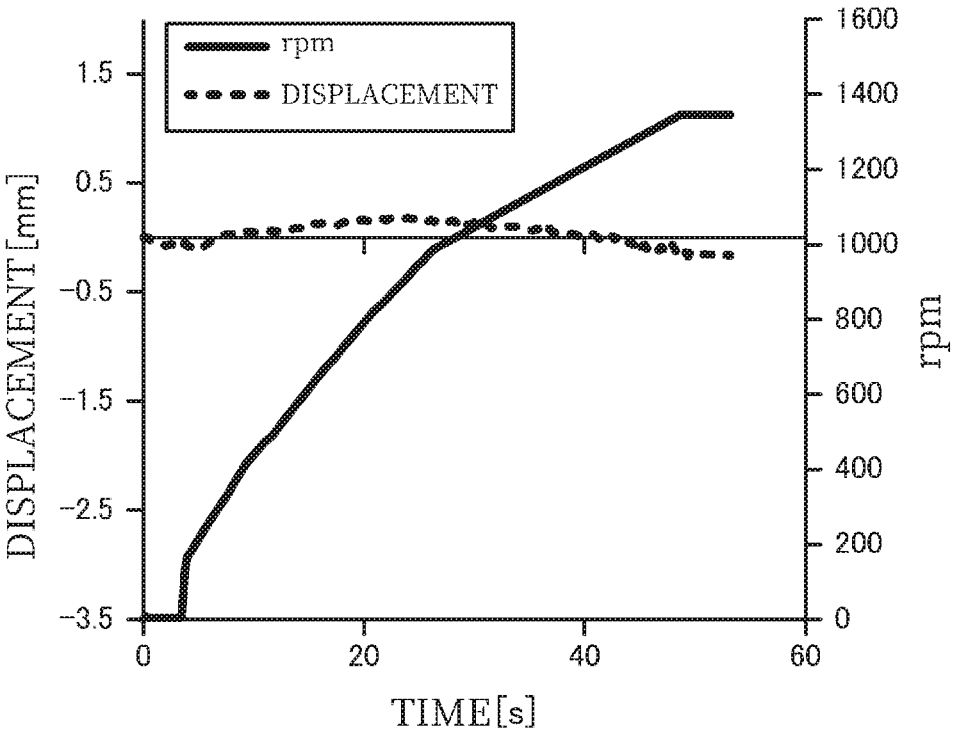
FIG. 8B is a graph illustrating the relationship between change in revolution per minute (rpm) of a drum and the degree of displacement (mm) of a tub forward during spin-drying of a washing machine (Present Embodiment).

FIG. 8A is a graph illustrating the relationship between changes in revolutions per minute (rpm) of a drum and the degree of displacement (mm) of a tub moving forward during spin-drying of a washing machine as a comparative embodiment before the air inlet and the air inflow path are formed. FIG. 8B is a graph illustrating the relationship between changes in rpm of a drum and the degree of displacement (mm) of a tub moving forward during spin-drying of a washing machine having the abovementioned air inlet and air inflow path according to the present disclosure.

As apparent from these graphs, while the tub moves forward 3 mm or more in the comparative embodiment, the tub does not move forward according to the present embodiment. Thus, it was confirmed that forward movement of the tub may be prevented by forming the air inlet.

Figure 9:
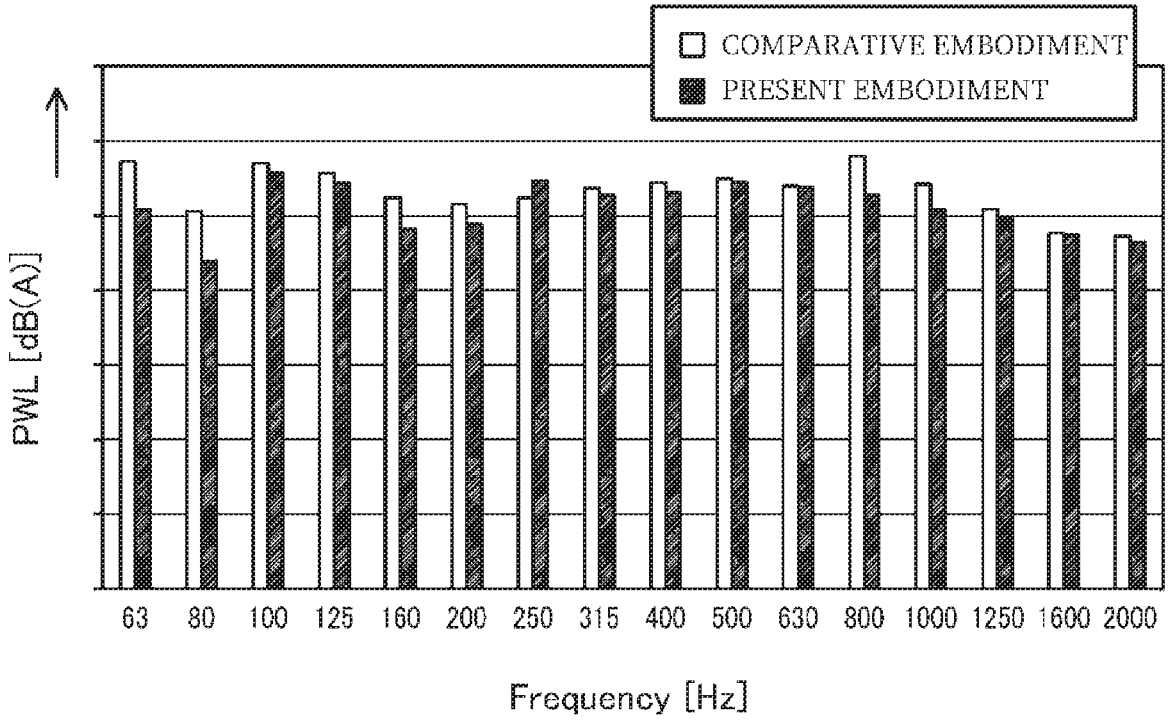
FIG. 9 is a graph illustrating noise levels (power level: PWL) during spin-drying of the washing machines according to the present embodiment and the comparative embodiment.

In addition, FIG. 9 is a graph illustrating noise levels (PWL) during spin-drying of the washing machines according to the present embodiment and the comparative embodiment. The horizontal axis indicates frequency (Hz).

As a tub moves considerably farther forward tub, the tub pushes a diaphragm more, thereby increasing a noise level (about 160 Hz). The washing machine according to the present embodiment produces less noise than the washing machine according to the comparative embodiment. Therefore, it was confirmed that noise suppressing effect may be obtained during spin-drying according to the present embodiment.

First Modified Embodiment

Figure 10:
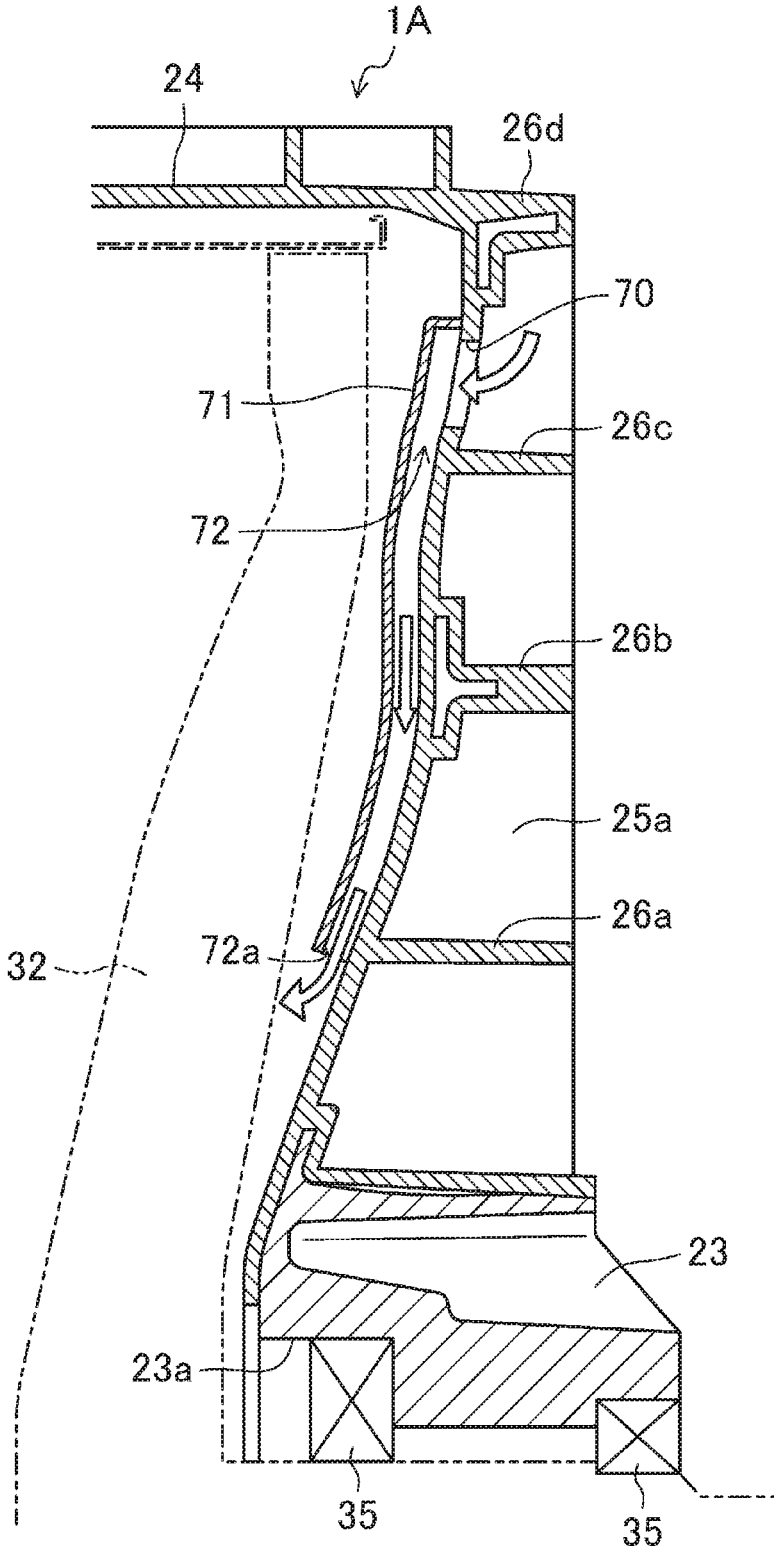
FIG. 10 is a schematic view (corresponding to FIG. 5) illustrating a first modified embodiment of the washing machine according to the present disclosure.

FIG. 10 illustrates a first modified embodiment of the washing machine 1 described above. A washing machine 1A according to the first modified embodiment has the same structure except for an air inflow structure in comparison with the aforementioned washing machine 1, and thus the same reference numerals are used and detailed descriptions thereof will not be repeated.

In the washing machine 1A, an opening (external air introduction opening 70) penetrating the wall surface of the end wall 22 is formed at an upper end portion, not the central region, of the end wall 22. Specifically, the external air introduction opening 70 is formed on the wall surface 22*a* of the end wall 22 defined by adjacent main diametric rib 25*a*, diametric rib 25*b*, third circumferential rib 26*c*, and fourth circumferential rib 26*d*.

A bend-shaped guide member 71 having a door-shaped cross-section, a closed upper end, and an open lower end is mounted on the inner surface of the end wall 22. Thus, a channel (inner channel 72) extending downward from the upper end along the inner surface of the end wall 22 is formed.

The upper end of the guide member 71 is disposed to cover the external air introduction opening 70, and the lower end of the guide member 71 is disposed at the central region of the end wall 22. Thus, in the washing machine 1A, an air inflow path is formed by the inner channel 72 communicating with the outside of the tub 20 via the external air introduction opening 70 and an air inlet is formed at a lower end 72*a* of the inner channel 72 communicating with the inside of the tub 20.

Since air is also introduced into the central portion of the tub 20 via the external air introduction opening 70, the inner channel 72, and the lower end 72*a* during spin-drying in the washing machine 1A, a pressure difference is not caused in the tub 20 during spin-drying while preventing water or bubbles from flowing out thereof during washing or rinsing.

In the case of the washing machine 1A, the structure of the outer surface of the end wall 22 may be the same as those of conventional washing machines. Thus, installation of the tub 20 with regard to the outer case 10 is not limited. Since the external air introduction opening 70 is formed at an outer peripheral portion of the end wall 22, rigidity of the tub 20 may be improved.

Second Modified Embodiment

Figure 11:
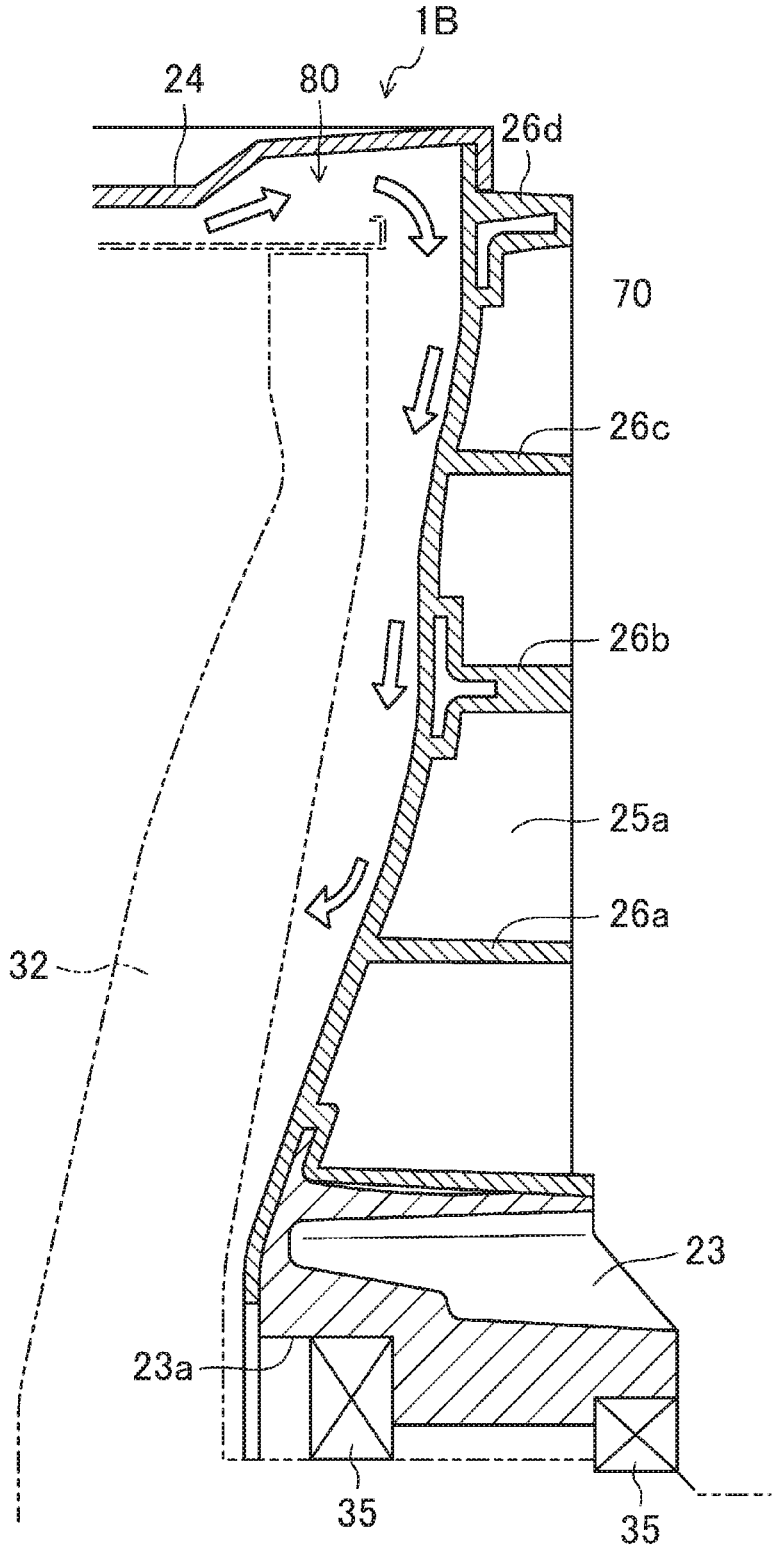
FIG. 11 is a schematic view (corresponding to FIG. 5) illustrating a second modified embodiment of the washing machine according to the present disclosure.

FIG. 11 illustrates a second modified embodiment of the washing machine 1 described above. A washing machine 1B according to the second modified embodiment has the same structure except for an air inflow structure in comparison with the aforementioned washing machine 1 or the washing machine A, and thus the same reference numerals are used and detailed descriptions thereof will not be repeated.

An air inflow structure of the washing machine 1B includes an airing path 80 formed by designing a gap between a rear end portion of the circumferential wall 33 and the main body wall 24 to be greater than a gap between a middle portion of the circumferential wall 33 (between the front end portion and the rear end portion of the circumferential wall 33) and the main body wall 24. That is, the gap between the circumferential wall 33 and the main body wall 24 is very small as a result of increasing the capacity of the drum 30. Thus, air does not easily flow through the gap and reflux of air is inhibited, so that a large amount of air is discharged out of the tub 20 through the water supply hose 6 or the drain hose 7 causing a pressure difference in the tub 20.

Therefore, in the washing machine 1B, the airing path 80 is formed by increasing an inner diameter of the upper corner to be greater than the other portions in the rear end portion of the tub 20 to enlarge the gap therebetween. Since the rear end portion of the circumferential wall 33 faces the airing path 80, the rear end portion of the circumferential wall 33 communicates with a gap (rear gap) between the end wall 22 of the tub 20 and the flange shaft 32 of the drum 30. Thus, a part of air flowing out of from the circumferential wall 33 of the drum 30 may be returned to the central portion of the drum 30 via the airing path 80 and the rear gap. That is, in this washing machine 1B, the airing path 80 and the rear gap constitute the air inflow structure.

In addition, the airing path 80 may be formed by making an outer diameter of the rear end portion of the drum 30 to be relatively small.

Third Modified Embodiment

Figure 12:
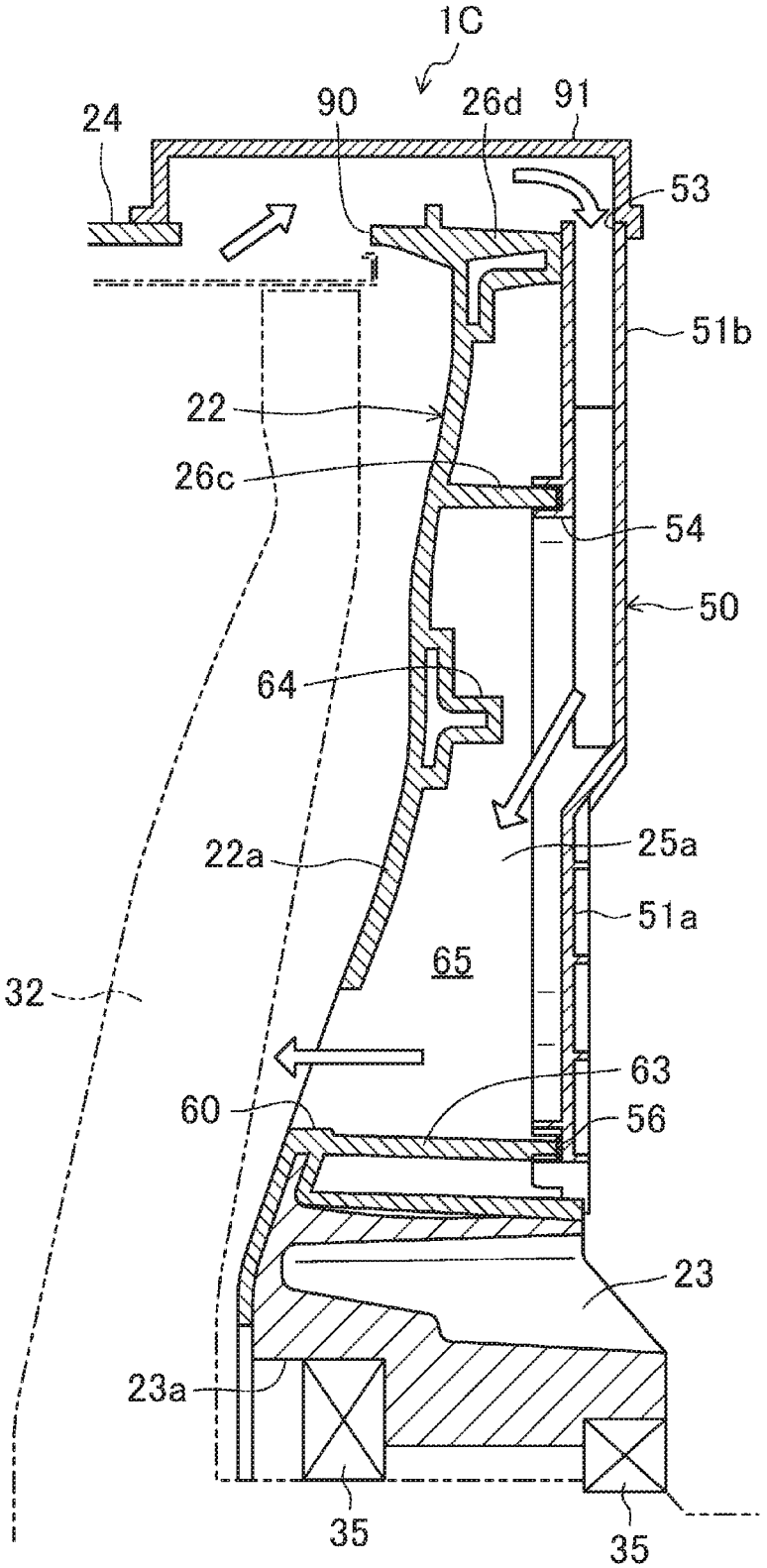
FIG. 12 is a schematic view (corresponding to FIG. 5) illustrating a third modified embodiment of the washing machine according to the present disclosure.

FIG. 12 illustrates a third modified embodiment of the washing machine 1 described above. A washing machine 1C according to the third modified embodiment has the same structure except for an air inflow structure in comparison with the aforementioned washing machine 1 or the like, and thus the same reference numerals are used and detailed descriptions thereof will not be repeated.

In the washing machine 1C, an air outlet 90 facing the circumferential wall 33 of the drum 30 is formed on a rear end portion of the main body wall 24 of the tub 20. In addition, the tub 20 is provided with an auxiliary cover member 91 and the auxiliary cover member constitutes a bypass communicating with the external air inlet 53. The air outlet 90 is covered by the auxiliary cover member 91. Thus, air flowing out of the air outlet 90 during spin-drying is returned to the central portion of the drum 30 through the bypass, the air inflow path, and the air inlet 60, so that a pressure difference is not caused in the tub 20, thereby suppressing the noise.

Fourth Modified Embodiment

Figure 13:
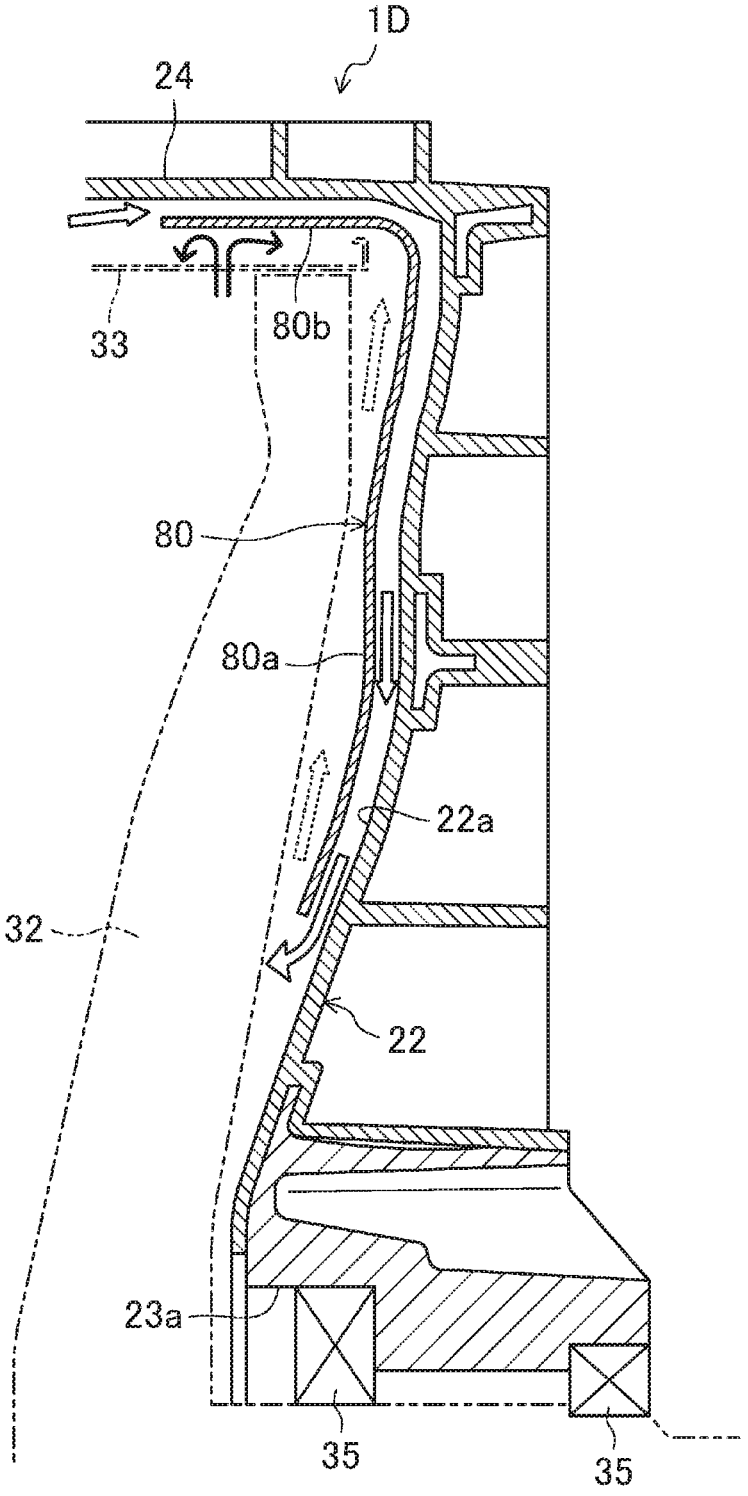
FIG. 13 is a schematic view (corresponding to FIG. 5) illustrating a fourth modified embodiment of the washing machine according to the present disclosure.

FIG. 13 illustrates a fourth embodiment of the washing machine 1 described above. A washing machine 1D according to the fourth modified embodiment has the same structure except for an air inflow structure in comparison with the aforementioned washing machine 1 or the like, and thus the same reference numerals are used and detailed descriptions thereof will not be repeated.

An air inflow structure of the washing machine 1D includes a baffle plate 80 disposed between the rear end portion of the drum 30 and the tub 20.

Specifically, the baffle plate 80 is disposed to expand in a gap between the inner surface of the tub 20 from a rear upper portion of the main body wall 24 to at least the central region of the end wall 22 and the outer surface of the rear end portion (particularly, the rear end portion of the circumferential wall 3 and the flange shaft 32) of the drum 30 and to face the inner surface of the tub 20 at an interval.

The baffle plate 80 is formed of a thin plate member and includes a main wall 80*a* expanding from the central portion of the end wall 22 to the upper end portion thereof along the inner surface of the wall surface 22*a* and a sub wall 80*b* connected to the main wall 80*a* and expanding forward along the inner surface of the main body wall 24.

An air path (baffle path) that induces an airflow from a front end portion of the sub wall 80*b* to the center of the main wall 80*a* is formed by the gap between the baffle plate 80 and the inner surface of the tub 20. A wall mount type or pillar type support member (not shown) is provided on the inner surface of the tub 20 facing the baffle plate 80 not to block the airflow and the baffle plate 80 is supported by the support member.

During spin-drying, air flowing out from the rear end portion of the drum 30 in the circumferential direction collides with the inner surface of the tub 20 and flows out of the tub 20 or is diffused forming turbulence if there is no sub wall 80*b*. However, if there is the sub wall 80*b*, the air collides with the side wall 80*b* and the baffle path is not influenced thereby, and thus air may be smoothly introduced into the baffle path.

An airflow in the radially outward direction from the central portion of the drum 30 is formed in the gap between the flange shaft 32 of the drum 30 and the inner surface of the wall surface 22*a* of the end wall 22 as shown by dashed lines of FIG. 13 when the drum 30 rotates at a high speed. Particularly, due to the arm portions 32*b*, a strong airflow may easily be generated by stirring the arm portions 32*b*. Thus, it is difficult for air to flow toward the central portion of the drum 30 in this gap.

Thus, the gap may be partitioned into one side of the flange shaft 32 and the other side of the end wall 22 by installing the baffle plate 80 and influence of a reverse airflow is not applied to the baffle path. Thus, air may be smoothly introduced toward the central portion of the drum 30.

Therefore, air flowing out of the drum 30 in the radially outward direction during spin-drying may be smoothly returned to the central portion of the drum 30 via the baffle path, and thus a pressure difference is not caused, thereby suppressing the noise.

The drum type washing machine according to the present disclosure is not limited to the aforementioned embodiments and may also include various other configurations. For example, although the air inlet is formed at the central region of the end wall 22 of the tub 20 in the washing machine 1 according to the present embodiment, an air inlet may also be formed at the center of the door 18 by mounting the guide member 71 described above with reference to the modified embodiments on the inner surface of the door 18 or the like. Similarly, the air inflow structure of each modified embodiment may also be installed at a front portion of the drum 30 or at both front and rear portions thereof.

As is apparent from the above description, according to the drum type washing machine of the present disclosure, noise generated during spin-drying may be suppressed, thereby improving comport.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A washing machine comprising:

a case comprising a laundry loading/unloading opening through which laundry is introduced;

a door mounted at the case to open or close the laundry loading/unloading opening;

a tub disposed inside the case;

a drum rotatably disposed inside the tub; and an air inflow channel configured to guide air between the drum and the tub to flow toward a central portion of the drum in which a pressure decreases while the drum rotates, wherein the tub comprises:

an opening connected to the laundry loading/unloading opening, an end wall facing the opening, wherein a rib radially extending from a center of the end wall is provided on an outer surface of the end wall, and a cover member mounted on an outer surface of the end wall and includes a rib-fitting part fitted to the rib, wherein the air inflow channel comprises an air inlet formed at one portion of the end wall, and wherein the cover member is configured to guide air into the air inlet.

2. The washing machine according to claim 1, wherein the air inflow channel is provided between a front end portion of the drum and the door or between a rear end portion of the drum and the tub.

3. The washing machine according to claim 2, wherein:

the tub comprises a main body wall that is cylindrical and faces a circumferential wall of the drum with a gap therebetween, and the air inflow channel is formed by a gap between at least one of a front end portion and a rear end portion of the circumferential wall and the main body wall that is greater than a gap between a middle portion of the circumferential wall and the main body wall.

4. The washing machine according to claim 1, wherein the air inlet is formed at a position higher than a rotational axis of the drum.

5. The washing machine according to claim 1, wherein the cover member constitutes the air inflow channel and comprising an external air inlet through which air is introduced, wherein the external air inlet is disposed at an upper portion of the tub.

6. The washing machine according to claim 5, wherein the rib constitutes one surface of the air inflow channel.

7. The washing machine according to claim 1, wherein:

the tub further comprises a main body wall that is cylindrical, an air outlet to discharge air is formed at one portion of the main body wall, and the air inflow channel connects the air outlet with the air inlet.

8. The washing machine according to claim 7, further comprising:

an auxiliary cover member mounted on an outer surface of the main body wall and configured to guide air from the air outlet to an upper portion of the cover member.

9. The washing machine according to claim 1, wherein the air inflow channel is formed by disposing a baffle plate extending between a rear end portion of the drum and the tub to face an inner surface of the tub with a gap therebetween.

10. A washing machine comprising:

a case comprising a laundry loading/unloading opening through which laundry is introduced;

a door mounted at the case to open or close the laundry loading/unloading opening;

a tub disposed inside the case and having an opening connected to the laundry loading/unloading opening, wherein a rib radially extending from a center of an end wall is provided on an outer surface of the end wall;

a drum rotatably disposed inside the tub; and an air inlet disposed at one surface of the tub or one surface of the door to allow air between the drum and the tub to flow to a central portion of the drum while the drum rotates, a cover member connected to the air inlet to constitute an air inflow channel configured to guide air and includes a rib-fitting part fitted to the rib.

11. The washing machine according to claim 10, wherein:

the tub comprises an end wall facing the opening, and the air inlet is formed at one portion of the end wall.

12. The washing machine according to claim 11, further comprising the cover member mounted on one surface of the end wall.

13. The washing machine according to claim 12, wherein:

the air inflow channel comprises an inlet through which air is introduced and an outlet through which air is discharged, and the inlet is disposed at a position higher than the outlet to prevent water contained in the tub from flowing out of the tub through the air inflow channel.

14. The washing machine according to claim 11, wherein:

the tub comprises a main body wall that is cylindrical, and an air outlet formed at one portion of the main body wall to discharge air contained in the drum while the drum rotates.

15. The washing machine according to claim 14, further comprising:

a cover member mounted on an outer surface of an end wall and configured to guide air into the air inlet; and an auxiliary cover member mounted on an outer surface of the main body wall and configured to guide air from the air outlet to an upper portion of the cover member.

16. A washing machine comprising:

a case comprising a laundry loading/unloading opening through which laundry is introduced;

a tub disposed inside the case, and comprising an end wall facing the laundry loading/unloading opening and a main body wall that is cylindrical, wherein a rib radially extending from a center of the end wall is provided on an outer surface of the end wall;

a drum rotatably disposed inside the tub and having a circumferential wall;

an air inflow channel configured to guide air between the drum and the tub toward a central portion of the drum while the drum rotates; and a cover member configured to constitute an air inflow channel configured to guide air and includes a rib-fitting part fitted to the rib.

17. The washing machine according to claim 16, wherein the air inflow channel is formed by a gap between at least one of a front end portion and a rear end portion of the circumferential wall and the main body wall that is greater than a gap between a middle portion of the circumferential wall and the main body wall.

18. The washing machine according to claim 16, wherein the air inflow channel is formed by disposing a baffle plate extending between a rear end portion of the drum and the tub to face an inner surface of the tub with a gap therebetween.

* * * * *